US005979407A

United States Patent [19]

Wang et al.

[11] Patent Number: 5,979,407

[45] Date of Patent: Nov. 9, 1999

[54] PASSIVE AND ACTIVE MISFIRE DIAGNOSIS FOR INTERNAL COMBUSTION ENGINES

[75] Inventors: Yue Yun Wang, Columbus; Edward J. Lewandowski, Scipio, both of Ind.

[73] Assignee: Cummins Engine Company, Inc., Columbus, Ind.

[21] Appl. No.: 09/088,934

[22] Filed: Jun. 1, 1998

[51] Int. Cl.[6] ..... F02M 7/00

[52] U.S. Cl. ..... 123/436; 123/479

[58] Field of Search ..... 123/436, 479; 73/119 A

[56] References Cited

U.S. PATENT DOCUMENTS

| | | | |
|---|---|---|---|
| 4,896,639 | 1/1990 | Holmes . | |
| 4,930,479 | 6/1990 | Osawa et al. . | |
| 4,932,379 | 6/1990 | Tang et al. . | |
| 4,993,389 | 2/1991 | Ahlborn et al. . | |
| 5,041,980 | 8/1991 | Maddock et al. . | |
| 5,086,741 | 2/1992 | Nakamura et al. . | |
| 5,237,504 | 8/1993 | Holmes et al. . | |
| 5,263,453 | 11/1993 | Wakahara et al. | 123/436 |
| 5,268,843 | 12/1993 | Imai . | |
| 5,365,780 | 11/1994 | Feldkamp . | |
| 5,377,536 | 1/1995 | Angermaier et al. . | |
| 5,446,664 | 8/1995 | Vossen et al. . | |
| 5,529,041 | 6/1996 | Andrews . | |
| 5,544,058 | 8/1996 | Demizu et al. . | |
| 5,559,285 | 9/1996 | Bryant et al. . | |
| 5,561,600 | 10/1996 | McCombie . | |
| 5,581,022 | 12/1996 | Sprague et al. | 123/436 |
| 5,625,143 | 4/1997 | Kadota . | |
| 5,638,278 | 6/1997 | Nishimura et al. . | |
| 5,687,692 | 11/1997 | Togai et al. . | |
| 5,709,192 | 1/1998 | Zimmermann | 123/436 |
| 5,822,710 | 10/1998 | Mezger et al. | 123/436 |
| 5,862,505 | 1/1999 | Fujki | 123/436 |
| 5,893,897 | 4/1999 | Volkart et al. | 123/436 |

OTHER PUBLICATIONS

Williams, Jeremy, "An Overview of Misfiring Cylinder Engine Diagnostic Techniques Based on Crankshaft Angular Velocity Measurements," Electronic Engine Controls, 1996, pp. 31–37.

*Primary Examiner*—John Kwon
*Attorney, Agent, or Firm*—Baker & Daniels

[57] ABSTRACT

A system and method for detecting a misfire condition for a cylinder of an internal combustion engine is based upon the firing times for each cylinder and a comparison of firing times between successive cylinders in the engine firing sequence. A differential firing time parameter represents the result of this comparison and is used a passive test to determine whether a particular cylinder is misfiring. Cylinders identified in the passive test are subjected to an active test in which the cylinder is overfueled by increasing amounts for each engine cycle after commencement of the active misfire test. The change in differential firing parameter for the identified resulting from the overfueling is compared to an active test threshold value indicative of an expected change for a healthy cylinder. A cylinder falling outside this active threshold value is determined to be a bad cylinder.

26 Claims, 5 Drawing Sheets

PASSIVE AND ACTIVE MISFIRE DIAGNOSIS FOR INTERNAL COMBUSTION ENGINES

BACKGROUND OF THE INVENTION

The present invention concerns a system and method for detecting misfires of cylinders of an internal combustion engine. The invention contemplates the detection of misfires or lack of combustion of individual faulty cylinders of an engine, and particularly for engines having a microprocessor based electronic control module, or ECM.

The Clean Air Act of 1975 sought to control exhaust emissions from internal combustion engines for light duty motor vehicles. In response to that Act, most automotive manufacturers have employed catalytic converters to control the emission of carbon monoxide, hydrocarbons and other noxious gases. Recently, regulatory agencies have proposed that passenger, light-duty and medium-duty vehicles incorporate some form of indicator to indicate a malfunction of an emission-related component that interfaces with the on-board engine control computer or microprocessor.

Misfire of engine cylinders can damage the catalyst of a catalytic converter. Some regulations for spark-ignition engines require identification of a misfiring cylinder as well as a percent misfire over a predetermined number of engine cycles. Other regulations have specifically targeted diesel engines. For example, the California Air Resources Board has initiated an On Board Diagnostics program, OBD II, that requires monitoring of each cylinder at least once per driving cycle. The OBD II regulations require that the diagnostic system be able to identify multiple faulty cylinders and provide a driver-observable indication of the fault condition.

Many techniques and systems have been proposed to detect and identify faulty cylinders. Some of these techniques are summarized in SAE Paper No. 960039, entitled "An Overview of Misfiring Cylinder Engine Diagnostic Techniques Based on Crankshaft Angular Velocity Measurement". The approaches summarized in this technical overview generally concentrate on crankshaft speed and angular velocity or torque variations.

Other approaches are briefly discussed in U.S. Pat. No. 5,529,041 to Andrews, owned by the assignee of the present invention. The systems summarized in the '041 Patent are characterized as "passive" monitors, meaning that they monitor each cylinder's contribution to engine speed under normal fueling conditions and register a misfire upon detection of a characteristic deceleration. As noted in the background of the '041 Patent, which text is incorporated herein by reference, passive systems are susceptible to certain errors, such as false positive failures, and often incapable of detecting "weak" misfire conditions such as may occur at low idle.

In response to the noted deficiencies of the prior passive systems, the inventor in the '041 Patent proposed an "active" misfire detection strategy that was inherently more robust than the prior systems and less likely to incorrectly detect engine misfires. The details of this prior inventive system can be discerned from the specification of the '041 Patent, which is also incorporated herein by reference. In brief, the '041 Patent describes an active monitoring system that senses engine rotational speed at predetermined crank angles corresponding to specific cylinders. The active aspect of the invention of the '041 Patent involves providing a quantity of fuel to the cylinder being tested that exceeds the fuel demanded by that cylinder. If the engine speed at the specific crank angle does not increase in accordance with the excess quantity of fuel, then the subject cylinder is identified as misfiring.

The system and method disclosed in the '041 Patent solves many of the problems associated with the prior passive approaches. However, this active approach has its own drawbacks. For instance, since this active detection system requires overfueling a subject cylinder, the misfire detection test is designed to be conducted only once per driving cycle or vehicle trip. Moreover, since the active approach involves overfueling, some deliberate intervention is required to initiate the test sequence.

Another difficulty with the prior misfire detection systems resides in the manner in which the occurrence of a misfire is detected. For example, some systems rely upon crankshaft angular velocity, while others utilize engine speed fluctuations. These approaches can complicate the misfire detection algorithms that must be implemented by the ECM.

Moreover, none of these prior systems adequately address the variations in proper cylinder firing vs. misfiring that occur due to changes in the overall engine operating condition. In addition, the need remains for a misfire detection system and method that can provide a quantitative evaluation of the nature or degree of the misfire condition of the affected cylinder(s).

SUMMARY OF THE INVENTION

The needs left unresolved by the prior devices are addressed by the combination of passive and active misfire detection implemented according to the present invention. In one aspect of the invention, cylinder firing times are determined and firing time differentials calculated for each cylinder. These firing time differentials can be obtained over a single engine cycle (i.e., two revolutions for a typical diesel engine), or can be averaged for each cylinder over a number of engine cycles.

In accordance with the invention, a passive misfire detection sequence involves comparing the firing time differential value for each cylinder to a diagnostic threshold. Cylinders failing this comparative test are identified as potentially defective or bad cylinders.

One feature of the invention provides a comparative measure of the severity of the cylinder misfire condition by evaluating the firing time differential value for the affected cylinder to obtain a percent combustion value for the cylinder. In one embodiment, a table is provided containing "acceptable" firing time differentials for different coolant temperatures. A ratio of the cylinder firing time differential and the temperature dependent acceptable firing time differential is indicative of the percent combustion for the affected cylinder.

The passive test can be conducted at any engine speed without affecting engine operation or requiring external intervention. Preferably, though, the passive test is conducted at low idle with the engine at operating temperature. The outcome of the passive test can be used to determine if the active misfire detection protocol is warranted. For example, even though a cylinder is marked as defective, immediate intervention may not be indicated based upon the percent combustion value for that cylinder. Moreover, the passive misfire diagnostic technique can be susceptible to false failures in which an otherwise healthy cylinder will be labeled as defective.

In order to ferret out the false failure, the present invention implements an active misfire test that utilizes some aspects of the overfueling approach described in the '041 Patent. Unlike that prior approach, the present invention does not evaluate engine speed deviations between cycles. Instead, the present invention utilizes the differential firing time values as the basis for certain comparative tests. In this aspect of the invention, the active misfire detection system and method relies upon empirically derived data for changes in differential firing times based on successively increasing cylinder overfueling amounts. In other words, in one component of the active test the suspect cylinder is overfueled by increasing amounts over successive test cycles. The empirically derived limit values relate changes in differential firing times to the overfuel amounts. The actual change in firing time differential for the subject cylinder can be compared to the specific limit value for the particular overfuel amount to ascertain whether the cylinder is defective in some way.

According to the present invention, the active test continues for a predetermined number of test cycles, with the cylinder overfuel amount increasing at each cycle. If the change in cylinder firing time differential exceeds the empirical limit value during any test cycle then the cylinder is deemed healthy. If the cylinder fails the differential limit test after a maximum number of successive test cycles it is determined to be defective. The amount of overfuel at which the cylinder passes the differential test limit also serves as a subjective measure of the severity of the cylinder defect. For instance, a cylinder that passes after the fourth active test is likely suffering from a more significant defect than a cylinder that passed after the first test cycle.

It is one object of the present invention to provide a system and method for determining whether cylinders of an internal combustion engine are defective or misfiring. Another object is to provide a misfire detection protocol that incorporates passive and active tests.

One benefit of the present invention is that it utilizes a passive test as a first level of discrimination for detecting cylinder misfire conditions. A further benefit is realized by the active test that permits a subjective assessment of the severity of the cylinder misfire condition.

Other objects and benefits of the present invention can be discerned from the following written description and accompanying figures.

DESCRIPTION OF THE PREFERRED EMBODIMENTS

Figure 1:
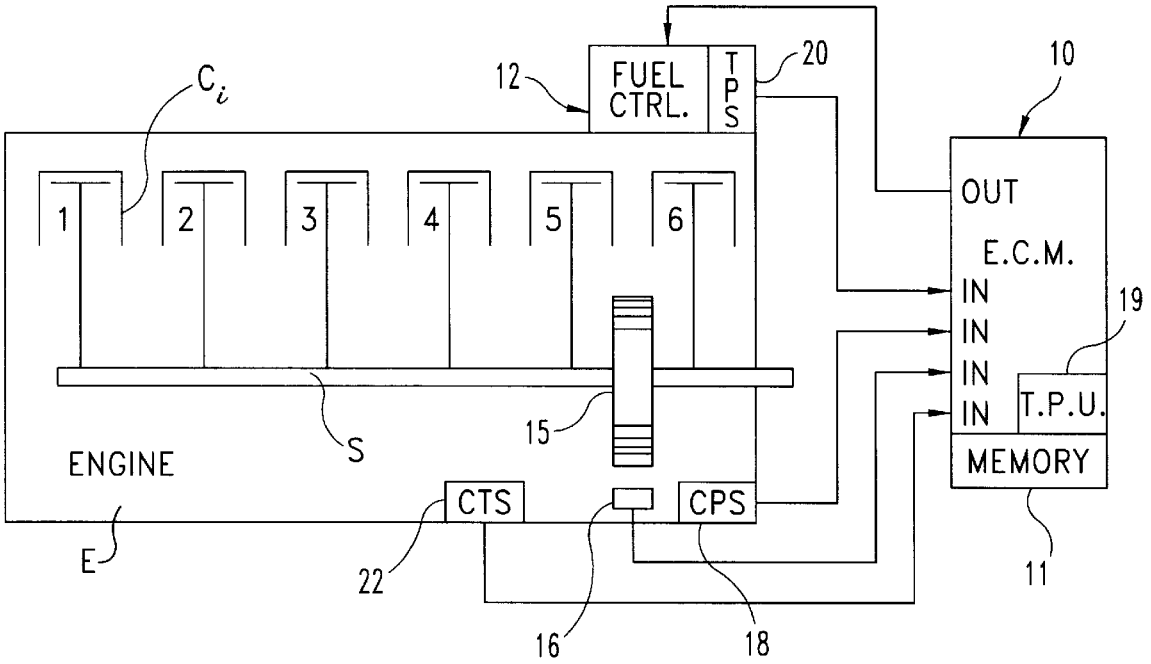
FIG. 1 is a schematic representation of an internal combustion engine incorporating the cylinder misfire detection system in accordance with one embodiment of the present invention.

For the purposes of promoting an understanding of the principles of the present invention, reference will now be made to the embodiments illustrated in the drawings and described herein. It is understood that no limitation of the scope of the invention is intended by the specific figures and description. Alterations and modifications of the illustrated system and method as would occur to persons of ordinary skill in the art are contemplated.

The present invention contemplates a system and method for use with a computer controlled internal combustion engine. In the illustrated embodiments, the engine is described as a six-cylinder diesel engine. However, it is understood that the principles of this inventive system and method can be applied equally well to spark ignition engines and engines having three or more cylinders.

As illustrated schematically in FIG. 1, an engine E includes a crankshaft S driven by a number of combustion cylinders C. The cylinders C can number two or more and can be arranged in-line or in a V configuration. In the illustrated embodiment, the engine E includes six cylinders, designated herein as cylinders #1 through #6. An engine control computer 10 controls the operating conditions of the engine E. The engine control computer 10 can be of known design to provide electronic control of engine components, such as the fuel control system 12, in accordance with predetermined algorithms. In the illustrated embodiment, the engine control computer implements a series of software instructions stored in memory 11 with program flow being controlled by engine operating parameters, such as accelerator pedal position and engine loading conditions. The ECM 10 can receive signals from a throttle position sensor (TPS) 20 and a coolant temperature sensor (CTS) 22, which signals are used by engine control algorithms. The ECM 10 generates control signals transmitted to the fuel control module 12 that is operable to control the amount of fuel provided to each cylinder 1–6.

In one aspect of the invention, a tone wheel 15 is mounted for rotation with the engine crankshaft S. In one specific embodiment, the tone wheel 15 includes 35 teeth spaced at ten degree intervals, with one tooth missing for use as a calibration point. An electromagnetic sensor 16, which can be a Hall effect sensor, is mounted adjacent the tone wheel and provides a signal to the engine control computer 10 upon passage of a tone wheel tooth. The tone wheel 15 of the illustrated embodiment includes 35 teeth, although more teeth can be provided a finer resolution for sensing the speed fluctuation, or to account for a greater number of engine cylinders.

The engine control computer 10 provides discrete control of the cylinder firing based upon angular position from top-dead-center (TDC) on the tone wheel. Alternatively, the engine E can be provided with a cam position sensor (CPS) 18 to sense a calibration position from which top-dead-center can be extrapolated. For example, the first cylinder #1 can be calibrated to fire at thirty degrees from TDC, which translates to the passage of three teeth of the tone wheel 15 past the Hall sensor 16. In a typical six cylinder engine, the cylinder firing times are measured from 30° after top-dead-center and continuing to 120° on the crankshaft S. In this typical engine, the tone wheel will turn two revolutions for firing all six cylinders, so one firing time will span twelve teeth on the tone wheel 15.

Figure 2:
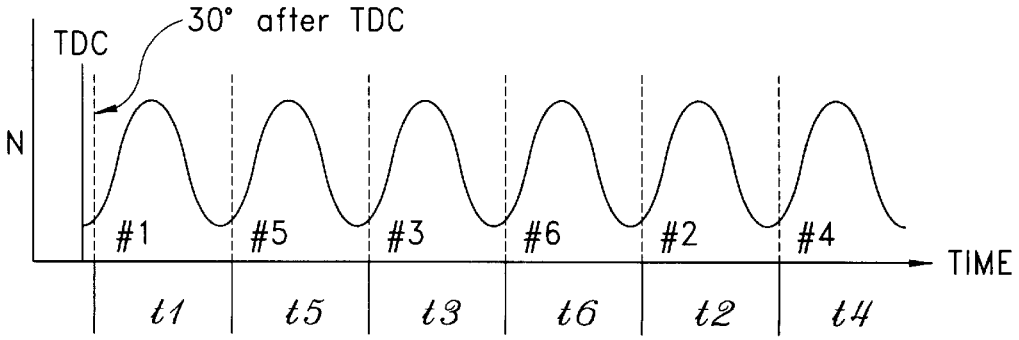
FIG. 2 is a graphical representation of engine speed over time with cylinder firing times identified.

The firing interval for the cylinders can be determined in the present embodiment using a time processing unit (TPU) 19 integrated into the engine control computer 10. As depicted in FIG. 2, each of the six cylinders of the illustrated engine fire in a predetermined sequence, in this case 1-5-3-6-2-4. This TPU 19 provides accurate high frequency clock pulses using, for example, a 100 kHz clock. The TPU 19 counts the number of clock pulses occurring between passage of the "firing" tooth for each cylinder—i.e., the tooth number corresponding with instructions from the engine control computer 10 directing combustion in the cylinder.

The time period $t_i$ between sequential cylinder firings can be determined in this way to generate a time value for each cylinder, corresponding in the illustrated embodiment to times t1, t5, t3, t6, t2, and t4. Ideally, in a perfectly running engine, all of the time values t1–t6 are equal. However, each cylinder is mechanically different and each receives air and fuel in different quantities due to losses and tolerances in the engine components. Consequently, even in a well-tuned engine the firing time values will vary between cylinders. In many cases, firing time variations are not indicative of poor or deteriorating engine performance. The present invention is concerned with the other cases in which the firing time variations among cylinders are significant enough to suggest a problem with the engine. In some cases, these variations can be attributed to cylinder misfiring or lack of combustion. These cylinder conditions can be caused by a clogged fuel injector, cylinder leakage or fuel pump malfunctions, for example.

In accordance with the present invention, a firing time differential parameter $C_i$ is calculated for each cylinder by comparing the firing time of the subject cylinder to the firing time of the immediately preceding cylinder. Thus, an array of firing time differentials is obtained according to the following relationships: $C_1$=t4−t1; $C_2$=t6−t2; $C_3$=t5−t3; $C_4$=t2−t4; $C_5$=t1−t5 and $C_6$=t3−t6, where the values $C_i$ are the CPB values for each of the i cylinders. The differential parameter values $C_1$–$C_6$ are unitless values indicative of the difference in the number of clock pulses counted between successive cylinder firings.

Figure 3:
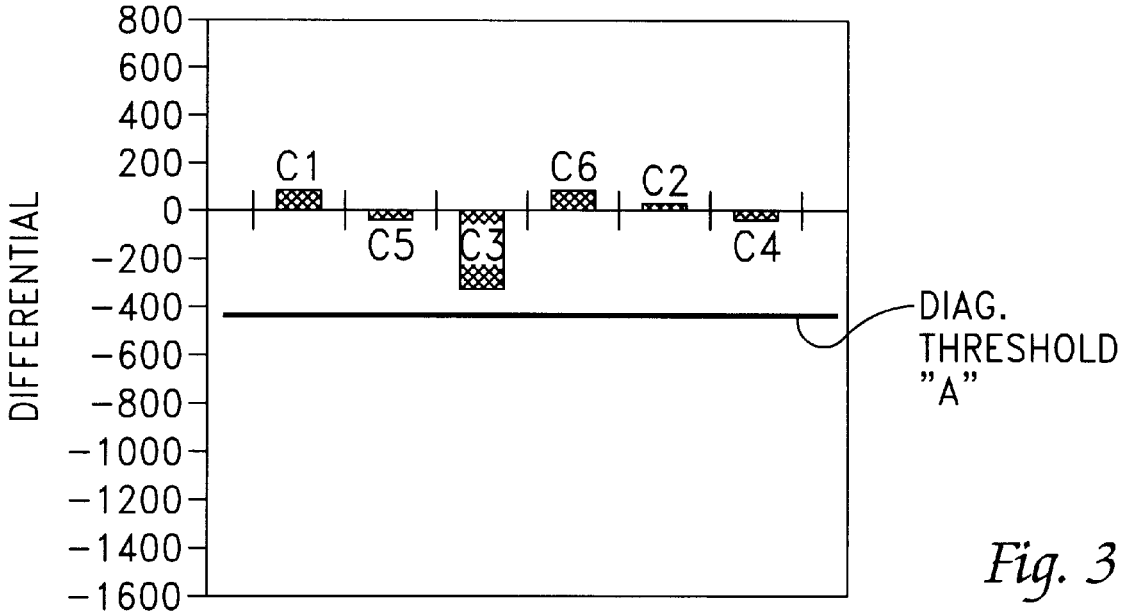
FIG. 3 is a graphical representation of firing time differentials for the cylinders of a typical six-cylinder engine under normal baseline operating conditions.

The bar graph in FIG. 3 illustrates baseline differential parameter values $C_i$ for the cylinders of the subject six cylinder engine in their firing order. In other words, the parameter values $C_1$–$C_6$ in the bar graph are indicative of a generally healthy engine with no appreciable power imbalance between cylinders, and no misfiring or loss of combustion in any particular cylinder. As can be seen in FIG. 3, the largest differential parameter value is $C_3$ corresponding to the differential firing time for cylinder #3. The negative magnitude of parameter $C_3$ means that the firing time for cylinder #3 exceeded the firing time of the immediately prior cylinder #5.

Figure 4:
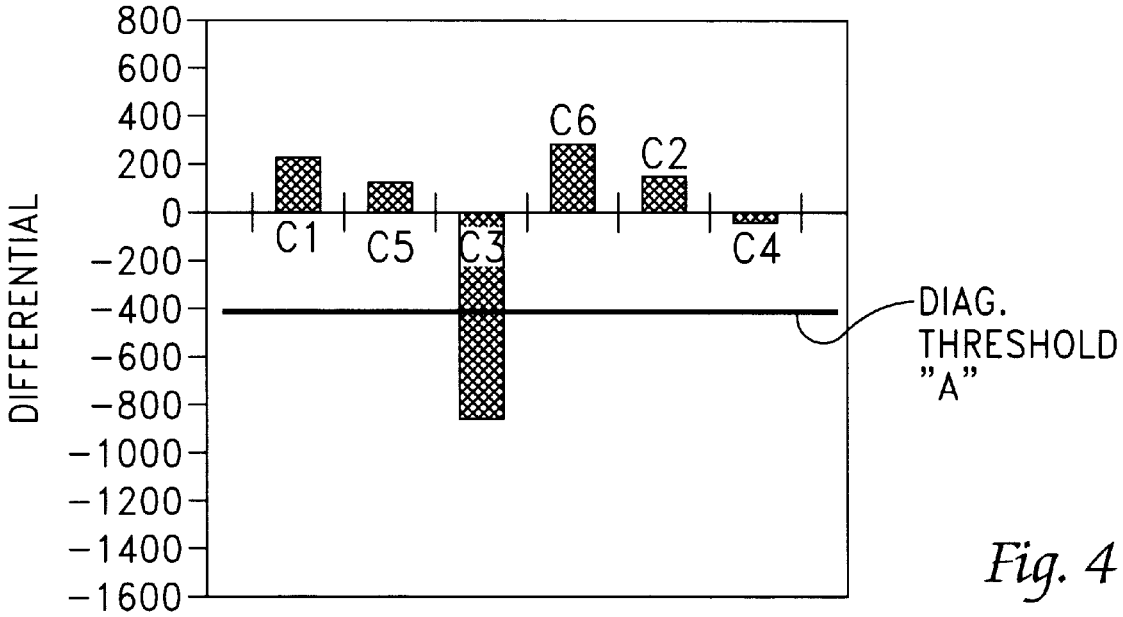
FIG. 4 is a graphical representation of firing time differentials for the engine cylinders under conditions in which one cylinder is misfiring.

In accordance with the present invention, a passive cylinder misfire test involves comparing each of the differential firing time parameters $C_i$ to a diagnostic threshold value A. The threshold value A is a negative value, as shown in FIGS. 3, 4 due to the nature of the cylinder misfiring or loss of combustion phenomenon. The normal engine retarding loads, such as friction, brake load and engine accessory load, try to slow the drive shaft S and are always working against the combustion power generated by each cylinder. When a cylinder misfires inadequate combustion power is generated by the cylinder to overcome these ever-present retarding forces. When a cylinder is unable to counter-act the engine retarding forces, its firing time increases, as occurred with the slower firing cylinder #3 shown in FIGS. 3 and 4, and the differential parameter will become increasing negative.

The threshold value A is pre-determined and can be stored in the memory 11 of the ECM 10. In some respects, the magnitude of the threshold value A can be arbitrary, based upon a desired engine performance level. For example, in the illustrated embodiment the threshold value A is based upon an empirically determined 50% combustion level at rated engine temperature. In this example, cylinders having differential firing time values less negative than the −400 value for A will have at least 50% combustion and will be, by definition, at least acceptable for continued operation of the engine. If higher performance standards are expected for a particular engine, the threshold value A can be greater—i.e., less negative—to produce a closer tolerance band for acceptable cylinder combustion.

On the other hand, when a parameter falls below or becomes more negative than the threshold value A, the cylinder is at least presumptively regarded as "bad" or defective. As shown in FIG. 4 the combustion difficulties experienced by cylinder #3 have increased to the point that its differential firing time parameter C3 reached −800, which is well below the diagnostic threshold value A. In fact, according to the present illustration, the value of parameter C3 indicates that cylinder #3 is out of combustion, meaning that it is essentially generating no combustion power. In this instance a cylinder overhaul would appear to be in order.

This passive misfire detection protocol can be implemented by a program stored within the memory 11 of the ECM 10. In one embodiment of the invention, the program can follow the flowchart shown in FIG. 5. The starting step 50 can be commenced automatically or following entry of an initiation command. The ECM can be programmed to initiate the passive test when the vehicle engine E is started. Alternatively, an externally issued command to the ECM can pass control to the passive misfire detection algorithm.

In accordance with the preferred embodiment of this invention, the passive test is conducted with the engine at low idle. Thus, in step 52 the engine operating conditions are sensed and evaluated to determine if the low idle criteria are met. In one specific embodiment, these criteria include 0% throttle position as registered by the TPS 20, vehicle speed at 0 mph, coolant temperature sensed by the CPS 18 at rated temperature (such as 140° F.) and the vehicle in drive gear with the foot brake applied, for a vehicle having an automatic transmission. Of course, the passive test can occur at other engine operating conditions with appropriate modifications and calibrations to the ECM and the passive misfire test algorithm. Preferably, the idle conditions will be stabilized for a predetermined period of time, such as 3 seconds.

If the low idle conditions are met in the conditional step 54, the program continues to determine the cylinder firing times t1–$t_i$ for all (i) of the cylinders. In this step 56, the TPU 19 is used to count the number of pulses corresponding to a firing time for each cylinder over one engine cycle. Alternatively, this step 56 can be performed over more than one engine cycle, with the firing time values representing an average of the firing times for each cycle per each cylinder.

The firing time differential parameters $C_1$–$C_i$ are calculated in step 58 according to the relationships set forth above. Specifically, the differential parameters are obtained by subtracting the firing time for one cylinder from the firing time for the immediately prior cylinder in the firing sequence. The differential parameters $C_i$ can be graphed as in FIGS. 3, 4. In the next step 60, each differential parameter $C_i$ for each cylinder is compared to the predetermined diagnostic threshold value A maintained in ECM memory. If the conditional step 62 is not met—i.e., the specific differential parameter is not less than the threshold value (meaning less negative than the threshold)—then the program flow continues at 64 to conditional step 76. A "no" answer to the conditional step 62 means that the differential parameter for the $i^{th}$ cylinder is within acceptable limits and the cylinder is not misfiring. In the conditional step 76, the program determines whether the last differential parameter $C_i$ has been evaluated. If so then the passive misfire test exits at branch 80. If additional differential parameters must be tested, then control passes through branch step 78 to the comparison steps 60, 62.

If a particular differential parameter $C_i$ corresponding to the $i^{th}$ cylinder passes the test of step 62, then the cylinder is marked as failing the passive test in step 66. In this case, the differential parameter for the cylinder is more negative than, and consequently less than the limit value A, pointing to a misfire problem with that cylinder. The step 62 can constitute setting a flag corresponding to the particular engine cylinder stored in memory 11 for later reference by the ECM and other diagnostic or evaluation routines. For example, the passive failure flag for each cylinder can be read by the ECM during the active misfire test algorithm to determine which cylinders will be subjected to the active test.

The next three steps 68, 70 and 72 provide a quantitative evaluation of the cylinder failing the passive misfire test. This quantitative evaluation attempts to quantify the degree of failure of the affected cylinder, as represented by the amount of combustion "remaining" in the cylinder. Unless the cylinder is catastrophically defective combustion will still occur and some combustion power will still be generated by the cylinder.

Figure 6:
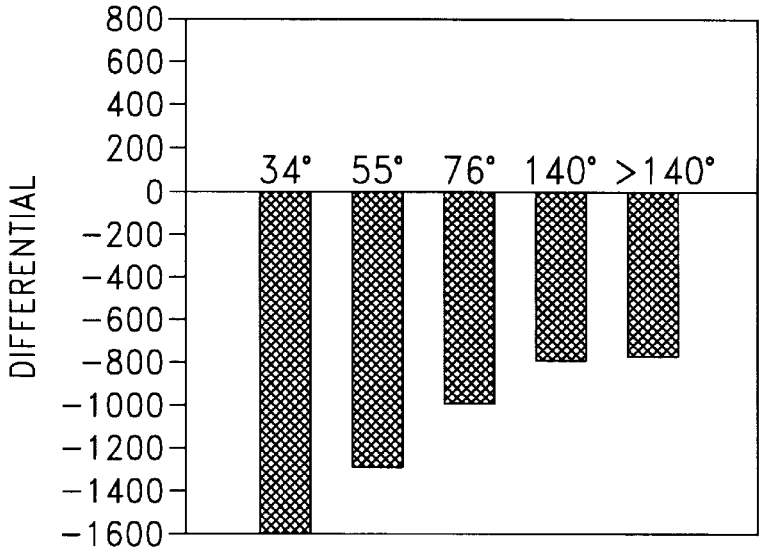
FIG. 6 is a graphical representation of a differential parameter as a function of engine coolant temperature in accordance with the passive misfire detection method of the present invention as represented in the flowchart of FIG. 5.

According to one aspect of the present invention, this remaining combustion can be quantified as a function of empirical data for a completely failed cylinder at certain engine coolant temperatures. This empirical data is summarized in the bar graph of FIG. 6. From this graph it can be seen that the firing time differential parameter for a "dead" cylinder increases, or becomes less negative, as the engine coolant temperature increases. As shown in FIG. 6, the differential parameter is about −1600 for a cold engine (34° F.) and gradually increases to about −800 at the rated operating temperature (140° F.).

With this empirical relationship in mind, it can be appreciated that the significance of a particular differential parameter value for a failed cylinder varies with the engine coolant temperature at which the passive test was conducted. For example, a differential parameter value of −800 means a dead cylinder if the test was conducted at operating temperature. On the other hand, this same parameter value for a cold engine test indicates that the affected cylinder provides 50% combustion.

Figure 5:
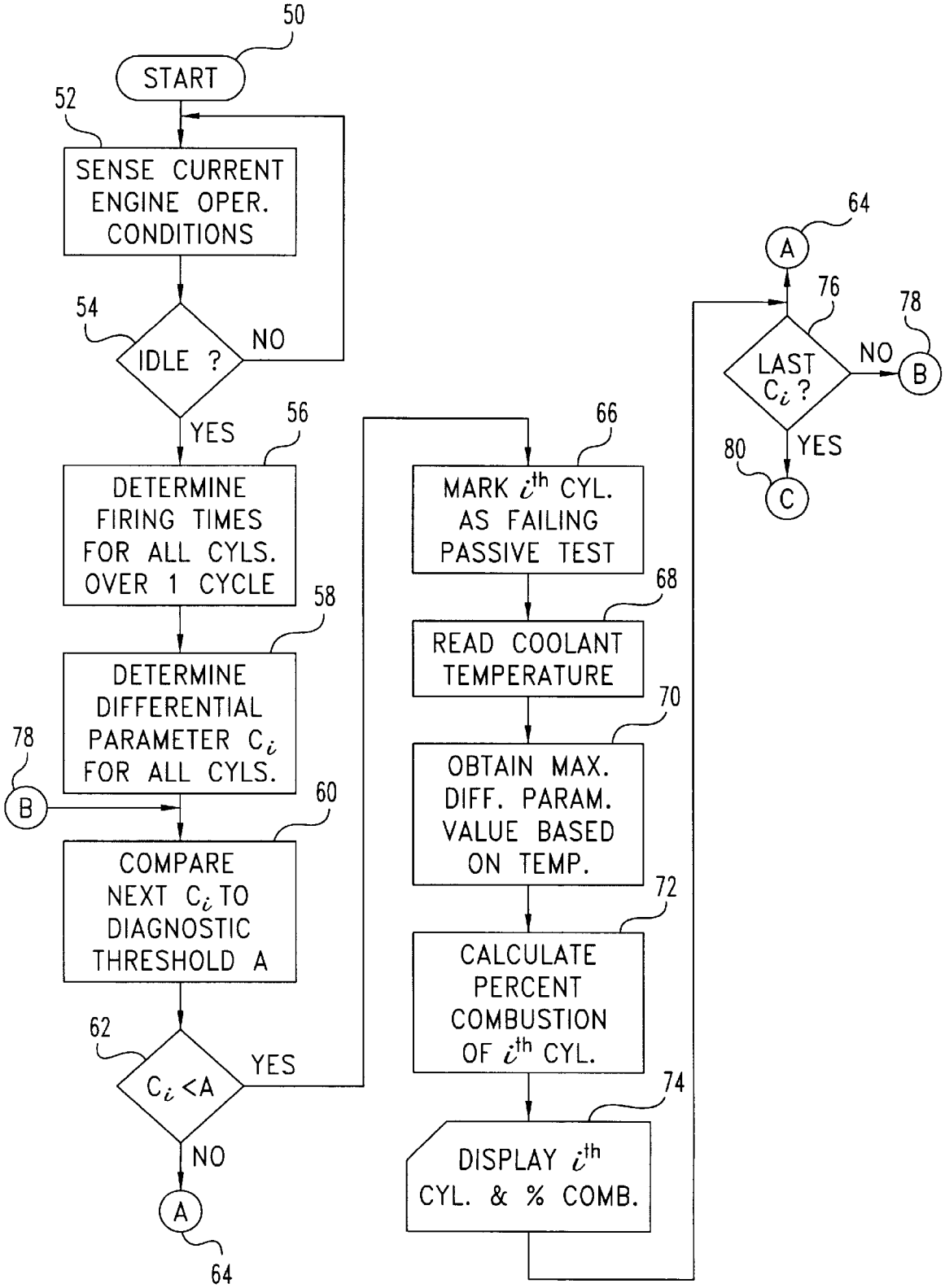
FIG. 5 is a flowchart of a passive misfire detection algorithm applied by the system according to one embodiment of the present invention.

Returning now to the flowchart of FIG. 5, the ECM reads the CTS 22 to determine the coolant temperature in step 68. In step 70 this temperature is used to obtain a maximum differential parameter value. This value can be acquired from a coolant temperature look-up table stored in the ECM memory, or can be obtained from an empirically or experimentally derived equation relating temperature to dead cylinder parameter values. The look-up table can be an inference table in which coolant temperatures within a particular range are assigned a specific maximum differential parameter value.

The percent combustion remaining in the cylinder is calculated in step 72 and the failed cylinder and its combustion value are displayed in step 74 for evaluation by the vehicle operator or an engine technician. According to the preferred embodiment, the combustion calculation follows the following equation:

% Combustion=

$$\left(1-\frac{\overline{C}}{C_{\max}}\right)\times 100\%,$$

where $C_{max}$ is obtained from the table look-up and $\overline{C}$ is the firing time differential parameter for a particular cylinder.

The firing time differential parameter used in this equation can be an instantaneous value obtained at a single engine cycle. Alternatively, the value for $\overline{C}$ can be a mean value of the cylinder parameter over N engine cycles, so that $\overline{C}$ can take the form:

$$\overline{C}_i=\frac{1}{N}\sum_{j=1}^{N}C_i(j),$$

where i=1–# cylinders.

The example depicted in FIG. 4 correspond to an automatic transmission vehicle. In the case of manual transmission vehicles, when the test is run with the clutch disengaged the engine retarding loads are lower. Consequently, the differentiation between the parameter $C_i$ for a healthy cylinder versus a dead cylinder will be less pronounced when the engine is at operating temperature. Nevertheless, the passive test of the present invention is able to locate a single cylinder or a multiple cylinder that is out of combustion, particularly if the diagnostic threshold value A is defined to capture cylinders that are more than 40% lacking in combustion. In order to increase the differentiation between a good cylinder and a low power cylinder, the passive test may be run with the vehicle in first gear with the clutch half engaged and the foot brake applied to increase the drivetrain retarding loads.

As discussed above in the Background, one problem with passive tests is the risk of a false negative, or a false identification of a cylinder as bad. In order to affirmatively identify a bad cylinder the present invention contemplates a second tier of testing using active overfueling of the cylinders identified as failing the initial passive test. According to this embodiment of the invention, overfueling a cylinder will increase the value of a differential parameter $C_i$. The active test has the same effect on a reduced combustion cylinder so that the negative differential parameter identified in the passive test will become less negative with overfueling. A cylinder that is completely out of combustion will experience no change in its differential parameter $C_i$ because no fuel within the cylinder is igniting.

In accordance with the present invention, the active test is implemented by the ECM 10 to cause the fuel control 12 to provide increased amounts of fuel to an identified cylinder according to a predetermined relationship. In the preferred embodiment this relationship is:

Fuel Amount=Commanded Idle Fuel+$j$*α, $j$=1, 2 . . . M, where $j$ corresponds to the test cycle, M is the maximum number of test cycles and α is a calibratable overfueling amount.

The active test is conducted for a maximum number of engine cycles (M) to verify that a cylinder is out of combustion or suffering from low combustion. Cylinders that are not complete bad may still pass the active test at the lower overfuel levels, so increasing overfuel amounts are intended to push the cylinder to its physical limits. If a cylinder passes the active test for all overfuel amounts up to the last test cycle M then it is deemed healthy. The maximum test cycle value M can be stored in the ECM memory 19, along with the calibratable overfueling amount a.

The calibratable overfueling amount a represents an incremental increase in the cylinder fueling from its baseline fueling condition. In the illustrated embodiment, the baseline fueling condition is the idle fuel amount commanded by the ECM 10 in accordance with its normal engine operating routines. Of course, if the active test is run at higher engine speeds, this baseline fueling condition will be increased accordingly based upon the engine operating routines. The calibratable overfueling amount $\alpha$ is preferably a constant value representative of a percent of the baseline fueling amount or a predetermined amount of fuel. For example, the amount $\alpha$ can be 20% of the baseline fueling amount, or the commanded idle fuel amount in one specific case. The overall fuel amount provided to a cylinder during the active test is shown graphically in FIG. 7. In this case, since the overfueling amount $\alpha$ is a constant the overfueling amount increases linearly with each test cycle. In the specific example, the affected cylinder will be provided with twice its normal commanded fuel amount at the fifth test cycle ($5\alpha=5 * 20\%=100\%$).

The calibratable overfueling amount a is maintained in the ECM memory 19. This calibratable value can be constant or variable, and if variable can be stored as a table look-up or separately calculated as a function of the number of test cycle being executed. Quicker resolution of a cylinder as bad can be achieved by increasing the slope of the overfueling line in FIG. 7.

Figure 7:
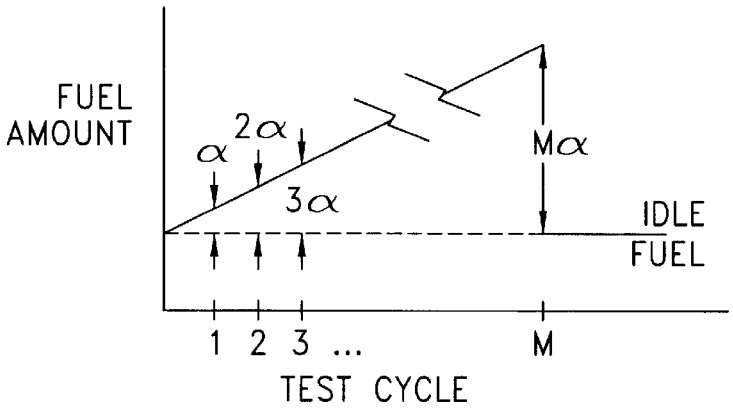
FIG. 7 is a graphical representation of overfuel amounts for successive test cycles according to the active misfire detection protocol of the present invention.

In one important aspect of the present invention, the active test applies a relationship between the overfueling amount depicted in FIG. 7 and its effect on the firing time differential parameter $C_i$ for a potentially bad cylinder. This relationship is shown graphically in FIG. 8. When additional fuel is provided to a cylinder, its firing time ordinarily decreases for a healthy cylinder, and even for a cylinder suffering from low combustion. A decrease in firing time for a cylinder translates directly to an increase (less negative) in the cylinder firing time differential parameter $C_i$. Thus, a relationship can be established between the amount of cylinder overfueling and an increase in the differential parameter from a baseline value. In the preferred embodiment, this baseline value for the differential parameter is the value calculated in the passive test algorithm. As suggested in FIG. 8, this relationship is best expressed as a value $\Delta C_i$. In the illustrated embodiment, an overfuel amount of $1\alpha$ will yield a increase in differential parameter, or $\Delta C_i$ of just over 100. This value for $\Delta C_i$ means that the value of the firing time differential parameter for the $i^{th}$ cylinder will increase or become less negative by 100 units if the cylinder is healthy.

Figure 8:
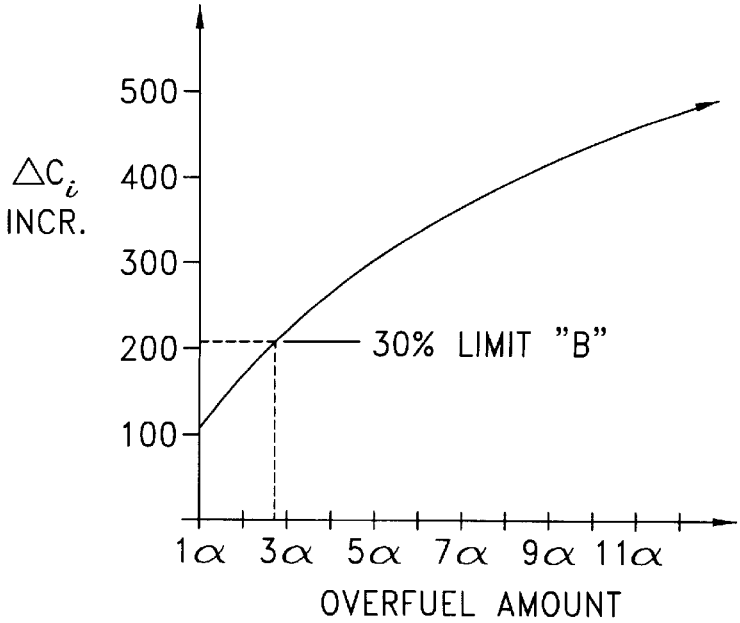
FIG. 8 is a graphical representation of a limit value based on the cylinder overfuel amounts depicted in the graph in FIG. 7 according to the active misfire detection protocol.

The graph in FIG. 8 represents the performance of a healthy cylinder. Of course, the active test applied by the present invention presumes that the subject cylinders are not healthy, having already failed the passive test. In accordance with one aspect of the inventive active test, a delta threshold value B is derived against which the actual change in the cylinder differential parameter is compared. The delta threshold value B can be predetermined and stored in memory or can be obtained from an equation. In one embodiment of the invention, the threshold value B is related to a reduced combustion limit after a predetermined number of test cycles.

In one approach, the goal of the active test is to identify bad cylinders with less than 30% combustion. At the maximum number of test cycles M a 30% combustion cylinder would burn only 30% of the fuel injected into a healthy cylinder. If in a specific case, the maximum cycle number M is 9 so that a healthy cylinder overfueled by $9\alpha$ would produce a $\Delta C_i$ of about 450 according to the graph in FIG. 8. A 30% combustion cylinder would burn significantly less fuel, given by the equation $9\alpha * 30\%=2.7\alpha$. Referring to the graph of FIG. 8, the $2.7\alpha$ value corresponds to a $\Delta C_i$ of about 200 units. According to the present invention, this value becomes the delta threshold B. This value can be stored as a constant in memory 19 and referred to by the active test algorithm implemented by the ECM 10. It is understood that different maximum test cycles M or different acceptable percent combustion limits will yield a different threshold B in this aspect of the invention.

Figure 9:
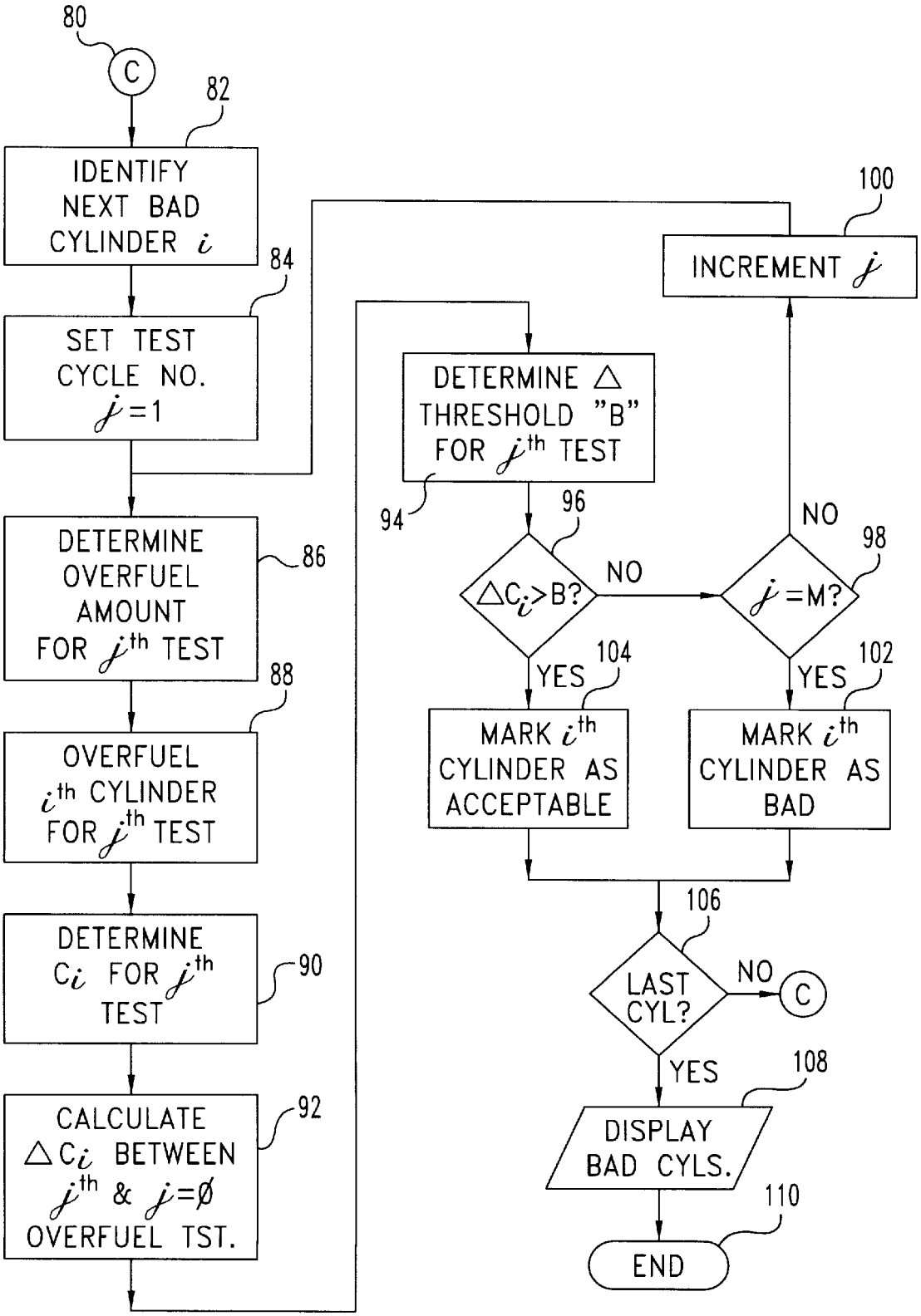
FIG. 9 is a flowchart of the active engine misfire detection algorithm according to one embodiment of the present invention.

The ECM 10 can include software to implement the active test of the present invention, as reflected in the flowchart of FIG. 9. The active test commences at step 80 following transfer from the passive test algorithm. The active test is conducted for each cylinder tagged as bad by the passive test, the cylinder being identified in step 82. For each cylinder, a sequence of test cycles j=1 . . . M is conducted. The preferred embodiment envisions conducting the complete test sequence independently for each bad cylinder so that only an isolated cylinder will be overfueled. Thus, in step 84 the test cycle value j is initialized.

In the next step 86, the amount of overfuel for the cylinder is ascertained. As explained above, this overfuel amount is related to the number of the test cycle j and the calibratable overfuel amount $\alpha$ as depicted in the graph of FIG. 7. This overfuel amount is conveyed to the cylinder fueling routines of the ECM 10 in step 88 which then directs the fuel control module 12 accordingly.

As the $i^{th}$ cylinder receives its additional quantity of fuel, the firing time and firing time differential parameter $C_i$ for the cylinder is calculated in step 90. This calculation can proceed as outlined above in describing the passive misfire test. In step 92 this new differential parameter $C_i$ for the $j^{th}$ test sequence is compared to the differential parameter obtained for the j=0 test, namely the passive misfire test, which had been previously stored in the ECM memory. A current delta value is obtained corresponding to the calculated difference between the current $C_i$ and the baseline differential parameter from the passive test. It is understood that for each of the active tests, the newly calculated differential parameter $C_i$ for all cylinders can be stored in ECM memory 19, although only the suspect cylinder is being evaluated.

In the next step 94, the delta threshold value B is determined as described above. Although this determination is made in step 94 in the illustrated algorithm, the value can be predetermined and stored in memory for use by the active misfire test routine. The delta differential parameter value is compared to the threshold value B in the conditional step 96. If the condition is not met, meaning that the delta threshold value was not exceeded, then the program flow is routed to conditional step 98 to determine if further test cycles are required. If the current test cycle number j is less than the maximum test cycle value M then j is incremented in step 100 and program control returns to step 86 to determine the next overfuel amount.

In accordance with one embodiment of the invention, if the last test cycle has been conducted (i.e., j=M in conditional step 98) then the routine identifies the current, or $i^{th}$, cylinder as a bad or misfiring cylinder in step 102. This step 102 is encountered only if the current cylinder has failed all of the delta differential parameter tests of step 96. Failing all of these tests means that for every overfueling amount for all M test cycles, the cylinder did not experience an acceptable increase in its firing time differential parameter.

On the other hand, once a cylinder passes the conditional step 96 it is marked as having acceptable combustion in step 104. In this embodiment, a cylinder need pass only one of the test sequences to be identified as an acceptable cylinder. The cylinder can pass the conditional test of step 104 on the first cycle j=1, or at the last cycle j=M. The amount of overfuel required to determine whether a cylinder is acceptable, or not sufficiently misfiring to call it bad, can provide an indication of the severity of the lack of combustion problem for the cylinder. For example, if the cylinder passes the active misfire test on the first test cycle, it is likely to be a healthy or 100% combustion cylinder. On the other hand, if the cylinder fails the test for all test cycles except the last, the cylinder likely has a combustion problem approaching the absolute limit used to determine the delta threshold value B. In the specific illustrated embodiment, a cylinder that passes only the last test after M cycles is a 20% combustion cylinder.

Once the current cylinder has been identified as bad in step 102 or acceptable in step 104, a determination is made in conditional step 106 whether the last cylinder has been evaluated. If other cylinders require active testing, having been flagged by the passive test sequence, then the program returns to step 80 to continue the misfire testing loop. If the last cylinder has been evaluated then the list of bad cylinders can be provided in step 108 and the active test routine ended in step 110. It is contemplated that the report of bad cylinders can take many forms depending upon the nature of information required by the engine technician or vehicle operator. For example, a complete summary of both the passive and the active tests can be provided for diagnosis by the technician. Alternatively, only the cylinder number can be displayed as an alert that the engine requires servicing.

While preferred embodiments of the invention have been illustrated and described in detail in the figures and accompanying specification, this description is not intended to be restrictive in character. Instead, it is understood that the present invention contemplates changes and modifications to the illustrated embodiments that may arise on consideration by a person of ordinary skill in the art to which this invention pertains.

What is claimed is:

1. A system for detecting a misfire condition in a cylinder of an internal combustion engine, comprising:

a sensor operable to transmit a plurality of timing signals corresponding to the position of the engine driveshaft at the firing of each cylinder in a firing sequence for each engine cycle; and an engine control module (ECM) receiving said timing signals and including;

a time processing unit operable to determine a firing time for each cylinder based on said plurality of timing signals;

means for determining a differential firing time parameter for each cylinder based upon the difference in firing time between each cylinder and the next prior cylinder in the firing sequence; and means for comparing said differential firing time parameter for each cylinder to a passive test threshold value and identifying cylinders falling outside said passive test threshold value as misfiring cylinders.

2. The system for detecting a misfire condition according to claim 1, further comprising:

a sensor for sensing an engine operating condition;

means within said ECM for determining a variable limit value for said differential firing time parameters of said cylinders based upon the magnitude of said sensed engine operating condition; and means for comparing said differential firing time parameter for an identified misfiring cylinder with said limit value and providing a value based on said comparison indicative of the percent combustion achieved by said identified cylinder.

3. The system for detecting a misfire condition according to claim 2, wherein said engine operating condition is engine coolant temperature and said sensor is a temperature sensor.

4. The system for detecting a misfire condition according to claim 2, wherein said variable limit value decreases with increases in the magnitude of said sensed engine operating condition.

5. The system for detecting a misfire condition according to claim 2, wherein said means for determining a variable limit value includes:

storing a table of said limit values for specific operating condition magnitudes in memory; and obtaining a limit value from said table based upon the sensed operating condition.

6. The system for detecting a misfire condition according to claim 1, wherein said ECM includes a memory for storing said differential firing time parameter for each of said cylinders.

7. The system for detecting a misfire condition according to claim 1, further comprising:

a fuel control module operable to control the amount of fuel provided to each cylinder of the engine in response to a fuel control signal;

means within said ECM for providing said fuel control signal according to a predetermined engine control routine to provide a predetermined amount of fuel to each cylinder; and means within said ECM for modifying said fuel control signal to increase the fueling to an identified misfiring cylinder above said predetermined amount of fuel dictated by the engine control routine upon commencement of an active misfire test.

8. The system for detecting a misfire condition according to claim 7, wherein said means for modifying said fuel control signal is operable to provide larger increases in fueling to said identified cylinder with each successive engine cycle after commencement of the active misfire test.

9. The system for detecting a misfire condition according to claim 8, wherein said means for modifying said fuel control signal increases the fueling by an amount equal to a quantity $j\alpha$, where j is the number of engine cycles after commencement of the active misfire test and $\alpha$ is a predetermined constant.

10. The system for detecting a misfire condition according to claim 9, wherein said constant $\alpha$ is related to a percentage of a low idle fuel amount commanded by said engine control routine.

11. The system for detecting a misfire condition according to claim 7, wherein said ECM further includes:

a memory for storing a baseline differential firing time for each identified misfiring cylinder corresponding to the differential firing time parameter compared to said passive test threshold value;

means for determining a change in differential firing time parameter for each identified cylinder relative to said baseline differential firing time parameter for each engine cycle after commencement of said active misfire test; and means within said ECM for comparing said change in differential firing time parameter to an active test threshold value and identifying cylinders falling outside said active test threshold value as bad cylinders.

12. The system for detecting a misfire condition according to claim 11, wherein said active test threshold value is related to a predetermined change in differential firing parameter for a healthy engine cylinder overfueled by the overfuel amount at each engine cycle after commencement of said active misfire test.

13. A system for active detection of a misfire condition in a cylinder of an internal combustion engine, comprising:

a fuel control module operable to control the amount of fuel supplied to each cylinder of the engine in response to a fuel control signal;

a sensor operable to transmit a plurality of timing signals corresponding to the position of the engine driveshaft at the firing of each cylinder in a firing sequence for each engine cycle; and an engine control module (ECM) receiving said timing signals and including;

means for providing said fuel control signal according to a predetermined engine control routine to provide a predetermined amount of fuel to each cylinder;

a time processing unit operable to determine a firing time for each cylinder based on said plurality of timing signals;

means for determining a differential firing time parameter for each cylinder based upon the difference in firing time between each cylinder and the next prior cylinder in the firing sequence over each engine cycle;

means for modifying said fuel control signal to increase the fueling to an identified cylinder above said predetermined amount of fuel dictated by the engine control routine upon commencement of an active misfire test;

means for determining a change in differential firing time parameter for said identified cylinder relative to a baseline differential firing time parameter obtained prior to commencement of the active misfire test, for each engine cycle after commencement of the active misfire test; and means within said ECM for comparing said change in differential firing time parameter to an active test threshold value and identifying cylinders falling outside said active test threshold value as bad cylinders.

14. The system for detecting a misfire condition according to claim 13, wherein said means for modifying said fuel control signal is operable to provide larger increases in fueling to said identified cylinder with each successive engine cycle after commencement of the active misfire test.

15. The system for detecting a misfire condition according to claim 14, wherein said means for modifying said fuel control signal increases the fueling by an amount equal to a quantity $j\alpha$, where j is the number of engine cycles after commencement of the active misfire test and $\alpha$ is a predetermined constant.

16. The system for detecting a misfire condition according to claim 15, wherein said constant $\alpha$ is related to a percentage of a low idle fuel amount commanded by said engine control routine.

17. The system for detecting a misfire condition according to claim 13, wherein said active test threshold value is related to a predetermined change in differential firing parameter for a healthy engine cylinder overfueled by the overfuel amount at each engine cycle after commencement of said active misfire test.

18. A method for detecting a misfire condition in a cylinder of an internal combustion engine comprising the steps of:

determining the firing time of each cylinder of the engine;

comparing the firing time of each cylinder with the firing time of the next prior cylinder in the firing sequence to obtain a differential firing time parameter for each cylinder; comparing the differential firing time parameter for each cylinder to a passive test threshold value; and identifying cylinders falling outside the passive test threshold value as misfiring cylinders.

19. The method for detecting a misfire condition in a cylinder of an internal combustion engine according to claim 18, further comprising the steps of:

determining a variable limit value for the differential firing time parameters based upon the magnitude of an engine operating condition;

comparing the differential firing time parameter of an identified cylinder with the variable limit value at a sensed engine operating condition; and calculating a percent combustion achieved by the identified cylinder based on said the comparison.

20. The method for detecting a misfire condition in a cylinder of an internal combustion engine according to claim 19, wherein the engine operating condition is engine coolant temperature and the step of determining a variable limit value includes sensing the engine coolant temperature.

21. The method for detecting a misfire condition in a cylinder of an internal combustion engine according to claim 19, wherein the step of determining a variable limit value includes determining a value for a differential firing time parameter of an out of combustion cylinder based on the engine operating parameter and deriving the variable limit value as a percentage of said value.

22. The method for detecting a misfire condition in a cylinder of an internal combustion engine according to claim 21, wherein the step of determining a variable limit value includes storing a look-up table of variable limit values for a plurality of engine operating condition magnitudes.

23. The method for detecting a misfire condition in a cylinder of an internal combustion engine according to claim 18, in which a predetermined amount of fuel is provided to each cylinder of the engine as determined by predetermined engine control routines implemented by an engine control module (ECM), wherein the method further comprises the steps of:

increasing the amount of fuel provided to an identified cylinder above the predetermined amount;

determining a change in differential firing time parameter for the identified cylinder resulting from the fuel increase;

comparing the change in differential firing time parameter to an active test threshold value; and marking an identified cylinder as bad if said change falls outside the active threshold value.

24. The method for detecting a misfire condition in a cylinder of an internal combustion engine according to claim 23, wherein the step of increasing the amount of fuel includes providing successively larger increases in fuel to the identified cylinder with each engine cycle after commencement of the active misfire test.

25. The method for detecting a misfire condition in a cylinder of an internal combustion engine according to claim 24, wherein the successively larger increases in fuel are equal to a quantity $j\alpha$, where j is the number of engine cycles after commencement of the active misfire test and $\alpha$ is a predetermined constant.

26. The system for detecting a misfire condition according to claim 25, wherein said constant $\alpha$ is a percentage of a low idle fuel amount commanded by said engine control routine.

* * * * *